US009610791B2

(12) United States Patent
Elferink

(10) Patent No.: US 9,610,791 B2
(45) Date of Patent: Apr. 4, 2017

(54) PRINT HEAD MOUNTING STRUCTURE

(71) Applicant: OCÉ-TECHNOLOGIES B.V., Venlo (NL)

(72) Inventor: Maarten J. H. Elferink, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/137,707

(22) Filed: Apr. 25, 2016

(65) Prior Publication Data

US 2016/0325569 A1 Nov. 10, 2016

(30) Foreign Application Priority Data

Jul. 23, 2015 (EP) ..... 15177971

(51) Int. Cl.

| | |
|---|---|
| ***B41J 2/165*** | (2006.01) |
| ***B41J 25/00*** | (2006.01) |
| ***B41J 2/01*** | (2006.01) |
| ***B41J 29/02*** | (2006.01) |

(52) U.S. Cl.

CPC ..... *B41J 25/001* (2013.01); *B41J 2/01* (2013.01); *B41J 29/02* (2013.01)

(58) Field of Classification Search

None

See application file for complete search history.

(56) References Cited

U.S. PATENT DOCUMENTS

| | | | |
|---|---|---|---|
| 4,613,246 | A | 9/1986 | Sugiura et al. |
| 6,726,307 | B2 | 4/2004 | Feiner |
| 2006/0192833 | A1 | 8/2006 | Samoto et al. |
| 2007/0115322 | A1 | 5/2007 | Slaats et al. |
| 2014/0292927 | A1 | 10/2014 | Tanaka et al. |

FOREIGN PATENT DOCUMENTS

| | | | |
|---|---|---|---|
| EP | 0 045 124 | A1 | 2/1982 |
| JP | 10-157157 | A | 6/1998 |
| WO | WO 2014/092140 | A1 | 6/2014 |

*Primary Examiner* — Alejandro Valencia

(74) *Attorney, Agent, or Firm* — Birch, Stewart, Kolasch & Birch, LLP

(57) ABSTRACT

A print head mounting structure includes a beam that extends along a scan axis y of the print head; and a carriage adapted to be driven for reciprocating movement along the beam. The carriage includes a print head carrier for carrying the print head, a cable guide carrier and a link. The print head carrier has a first runner block arranged to guide the print head carrier along the beam. The cable guide carrier is connected to a flexible cable guide that extends along the beam and has a second runner block arranged to guide the cable guide carrier along the beam independently of the print head carrier. The link connects the print head carrier and the cable guide carrier for joint movement along the beam, wherein the link is rigid and play-free in the direction of the scan axis y and is resilient in all remaining degrees of freedom.

13 Claims, 1 Drawing Sheet

PRINT HEAD MOUNTING STRUCTURE

CROSS REFERENCE TO RELATED APPLICATIONS

Figure 1:
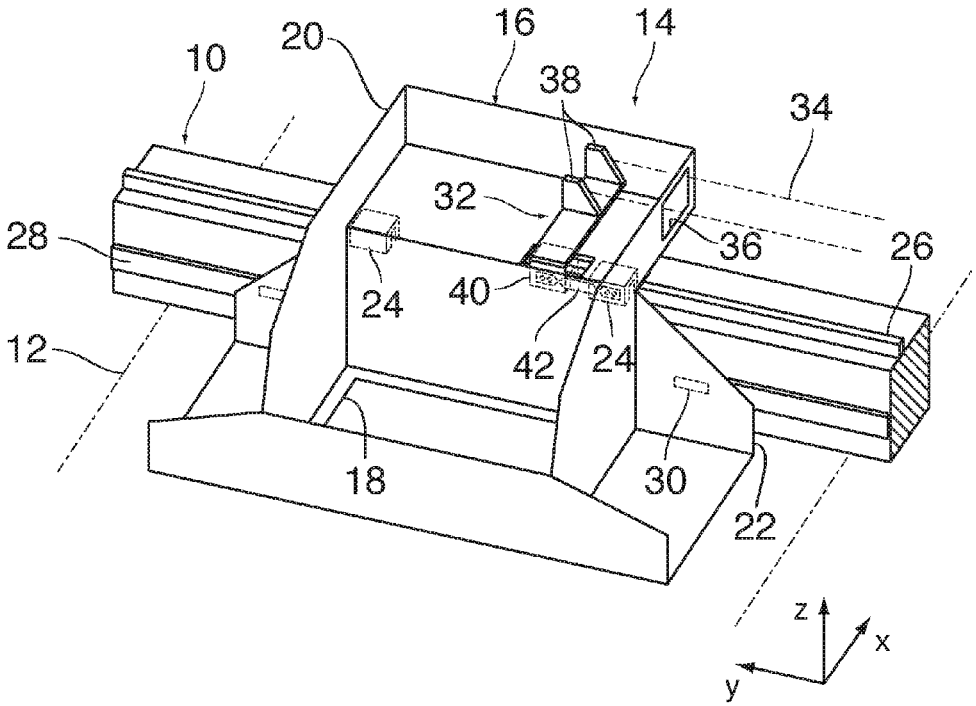

This non-provisional application claims the benefit under 35 U.S.C. §119(e) to U.S. Provisional Application No. 62/157,200, filed on May 5, 2015, and under 35 U.S.C. §119(a) to patent application Ser. No. 15/177,971.7, filed in Europe on Jul. 23, 2015, all of which are hereby expressly incorporated by reference into the present application.

The invention relates to a print head mounting structure comprising:

- a beam that extends along a scan axis y of the print head; and
- a carriage adapted to be driven for reciprocating movement along the beam, the carriage comprising:
  - a print head carrier for carrying the print head, the print head carrier having a first runner block arranged to guide the print head carrier along the beam,
  - a cable guide carrier connected to a flexible cable guide that extends along the beam, the cable guide carrier having a second runner block arranged to guide the cable guide carrier along the beam independently of the print head carrier, and
  - a link connecting the print head carrier and the cable guide carrier for joint movement along the beam.

In a printer having a reciprocating print head, e.g. an ink jet printer, control signals, electric power and consumables such as liquid ink are usually transmitted from a stationary part of the printer to the moving print head via flexible cables, tubes and the like. In order to prevent the cables and tubes from becoming entangled or getting caught at other parts of the printer, it is common practice to guide these cables and tubes in a cable guide that is typically configured as a caterpillar and restricts the movement of the cables to movements in a single plane, e.g. a vertical plane and extends in parallel with the scanning direction. However, the accelerations and decelerations of the reciprocating print head may induce vibrations in the cable guide and the cables, and as the cable guide is connected to the carriage, such vibrations may be transmitted to the print head, and this may degrade the quality of the printed images.

In order to cope with this problem, U.S. Pat. No. 6,726,307 B2 discloses a print head mounting structure wherein the carriage comprises a cable guide carrier that is separate from the print head carrier and is directly guided at the beam independently of the print head carrier. As a consequence, any vibration-induced torques or forces—except forces in parallel with the scanning direction—will at least to a major part be absorbed directly in the beam rather than being transmitted to the print head carrier and the print head. Since the print head carrier and the cable guide carrier have to move jointly along the beam, they are connected by a link which, however, has been designed so as to reduce the transmission of vibrations also in the direction in parallel with the scanning direction. To that end, the link is formed by a pin that projects from the cable guide carrier in a direction normal to the scanning direction and is engaged with play in all degrees of freedom in a slot in a socket that is fixed to the print head carrier. The slot extends in a direction that is normal to the direction of the pin and also normal to the scanning direction. Consequently, when the print head carrier is driven to move in either direction along the scan axis, one of the side walls of the slot will push and entrain the pin so as to move the cable guide carrier, whereas a relative movement of the pin and the socket is possible in lengthwise direction of the pin and also in lengthwise direction of the slot. Even vibrations of the pin in the direction of the scan axis can be suppressed to some extent, because the pin is not rigidly connected to the socket but engages the slot only with a certain play.

JP H10-157157 A discloses a similar mounting structure wherein the print head carrier and the cable guide carrier are jointly driven by a drive motor via a flexible belt. A portion of the belt that interconnects the print head carrier and the cable guide carrier forms a link that is resilient not only in the directions normal to the scan axis but also in the direction of the scan axis. This has the purpose that the forces that act upon the belt may cause a certain elastic expansion and contraction of the belt, so that vibrations will be attenuated rather than being transmitted from the cable guide carrier to the print head carrier.

It is an object of the invention to provide a print head mounting structure that permits a further improvement in the quality of the printed images.

In order to achieve this object, according to the invention, the link is rigid and play-free in the direction of the scan axis y and is resilient in all remaining degrees of freedom.

Similarly as in the prior art, the resiliency of the link in all degrees of freedom except translations in the direction of the scan axis prevents vibrations in these degrees of freedom from being transmitted to the print head carrier. However, in the direction along the scan axis, the rigid and play-free link according to the invention does not dampen or absorb any vibrations but, on the contrary, causes the print head carrier and the cable guide carrier to move as one rigid body. As the link is play-free in this direction, no shocks will be created when the direction of movement of the carriage is reversed. The rigidity of the link assures that any vibrations of the cable guide and the cable guide carrier cannot excite any oscillation modes of the link which could cause an oscillatory movement of the print head carrier and the cable guide carrier relative to one another. (More precisely, due to the rigidity of the link, the resonance frequency of such oscillations is shifted into a range far away from the vibration frequencies of the cable guide). Thus, the positions and movements of the print head carrier and the cable guide carrier in the direction of the scan axis, in which these carriers behave like a single rigid body, will be determined only by the drive mechanism which is arranged to forcibly drive the carriage, and any perturbations of this position and movement control are reduced to a minimum.

More specific optional features of the invention are indicated in the dependent claims.

Preferably, a drive mechanism, e.g. a rack-and-pinion type drive mechanism, an electromagnetic linear drive, a spindle drive, or a belt drive mechanism, for driving the carriage is arranged to exert its driving force directly onto the print head carrier, whereas the cable guide carrier is driven only via the link.

The link may be constituted by an elongated hinge plate that extends in parallel with the scan axis y. For example, the hinge plate may behave like a leaf spring to provide resiliency in the direction of one axis x among the two axes x and z that are normal to the scan axis y, and two hinge portions may be formed by cut-outs in the hinge plate to provide resiliency in the direction along the other axis z that is normal to the scan axis y.

Preferably, the beam has a guide rail that guides the runner blocks of the print head carrier and the cable guide carrier, and the link is attached to the guide blocks so as to be disposed in immediate vicinity of the guide rail. In other words, the distance between the link and the guide rail is small and practically negligible in comparison to the overall dimensions of the cable guide carrier and the print head carrier. This will assure that any forces of inertia that may be transmitted via the link when the carriage is accelerated or decelerated will not induce any substantial torque acting upon the print head carrier. As a consequence, any vibrations of the cable guide in the direction along the scan axis y will not translate into vibrations of the print head carrier in any of the directions normal to the scan axis.

In order to guide the print head carrier even more stably, the print head carrier may be guided at the beam by two runner blocks disposed at opposite ends of the print head carrier in the direction of the scan axis, and the runner block for the cable guide carrier may be disposed between the runner blocks for the print head carrier.

In one embodiment, the guide rail is provided on a top surface of the beam, and an additional guide surface may be provided on a side face of the beam, this additional guide surface being engaged, e.g. via air bearings, by a downwardly cranked part of the print head carrier. In this case, the weight of the print head carrier (and the cable guide carrier) will be supported by the guide rail on the top side of the beam, whereas the additional guide surface on the side face stabilizes the print head carrier against rotations about a longitudinal axis of the guide rail and about a vertical axis.

Figure 2:
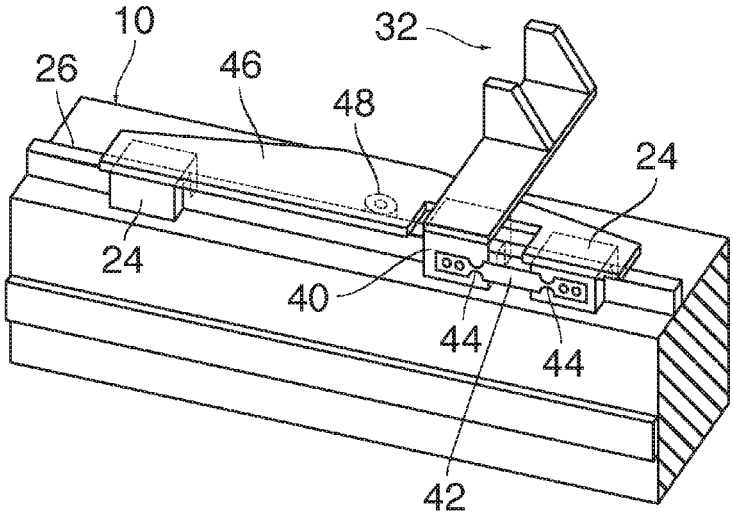

An embodiment example will now be described in conjunction with the drawings, wherein:

FIG. 1 is a schematic perspective view of a print head mounting structure according to the invention; and FIG. 2 is an enlarged view of parts of the mounting structure shown in FIG. 1.

As has been illustrated in FIG. 1, a print head mounting structure for a printer, e.g. an ink jet printer, comprises a beam 10 that is rigidly mounted in a frame (not shown) of the printer and extends horizontally, along a scan axis y, across a conveyor path 12 on which sheets of a recording medium (not shown) may be advanced in a direction (sub-scanning direction) of an axis x that is orthogonal to the scan axis y. A carriage 14 is supported and guided on the beam 10 and is arranged to be driven for reciprocating movement in opposite directions (main scanning directions) in parallel with the scan axis y. The carriage 14 comprises a print head carrier 16 with an opening 18 into which a set of print heads (not shown) may be inserted so as to be precisely aligned with the print head carrier 16 and to face the conveyer path 12.

In the example shown, the axes x and y define a horizontal plane, and the beam 10 and the carriage 14 are arranged such that bottom faces (nozzle faces) of the print heads are separated from the surface of the sheets on the conveyer path 12 only by a narrow gap in the direction of a vertical axis z.

The print head carrier 16 has a box-like top part 20 supported on the top side of the beam 10, and a downwardly cranked part 22 that extends downwardly along a side face of the beam 10 and forms the opening 18.

Two runner blocks 24 are fixed at the bottom side of the top part 20 of the print head carrier 16 and are disposed spaced apart at opposite ends of the print head carrier in the direction of the scan axis y. The runner blocks 24 straddle an upwardly projecting guide rail 26 that is formed on the top side of the beam 10. In this way, the weight of the print head carrier 16 is supported by the beam 10 and the print head carrier is accurately guided along the guide rail. Another guide surface 28 is formed on the front side face of the beam 10 and is engaged by the cranked part 22 of the print head carrier via air bearings 30. In this way, the print head carrier 16 and, accordingly, the print heads are precisely positioned in five degrees of freedom corresponding to translations along the axes x and z and rotations about all three axes x, y, z.

The carriage 14 further comprises a cable guide carrier 32 that is connected to one end of a cable guide 34 that has been shown only in phantom lines in FIG. 1. As is generally known in the art, the cable guide, which is typically configured as a chain or caterpillar, is used for guiding cables, tubes and the like which connect the print heads on the movable carriage 14 to the stationary part of the printer. In the example shown, the cable guide 34 passes through a window 36 in a wall of the box-shaped top part 20 of the cable guide carrier, and a last link of the cable guide is joined to a bracket 38 formed on the cable guide carrier 32.

On its bottom side, the cable guide carrier 32 has a runner block 40 that extends freely through a window in the bottom of the top part 20 of the print head carrier. Similarly as the runner blocks 24 of the print head carrier, the runner block 40 straddles the guide rail 26 so as to precisely position and guide the cable guide carrier 32. It will be observed however, that a vertical spacing exist between the bottom side of the cable guide carrier and the to surface of the bottom of the top part 20 of the print head carrier, and both the cable guide carrier 32 and the print head carrier 16 are directly guided at the guide rail 26 independently of one another, so that any vibrations that the movement of the carriage 14 may induce in the cable guide 34 and the cable guide carrier will not be transmitted to the print head carrier 16.

The runner block 40 of the cable guide carrier 32 and one of the runner blocks 24 of the cable guide carrier are connected to one another by a link 42 that extends in parallel with the scan axis y and has one end rigidly connected to a side face of the runner block 40 and the other end rigidly connected to a corresponding side face of the other runner block 24. When the print head carrier 16 is driven to move along the beam 10, the link 42 will entrain the cable guide carrier 32 so that the latter will move jointly with the print head carrier 16.

As can be seen more clearly in FIG. 2, the link 42 is configured as a hinge plate with four cut-outs that define two hinge portions 44 which make the link resilient in the direction of the axis z. The link 42 may also deform in the direction of the axis x like a leaf spring, so that the link permits relative movements of the cable guide carrier 32 and the runner block 40 on the one hand and the print head carrier 16 and the runner block 24 on the other hand in all degrees of freedom (rotations about all three axes and translations along the axes x and z) except translations in the direction of the scan axis y. In this latter direction, the link 42 establishes a rigid and play-free connection between the cable guide carrier and the print head carrier.

As is further shown in FIG. 2, the two runner blocks 24 for the print head carrier are connected to a plate-like sub-frame 46 that supports and rigidly mounts the print head carrier 16.

Further, as has been shown in phantom lines in FIG. 2, the sub-frame 46 may support components of a drive mechanism 48 for driving the print head carrier 16 along the beam 10. By way of example, the drive mechanism 48 may comprise a pinion that meshes with a rack (not shown) on the back side of the guide rail 26. In any case, the drive mechanism 48 is arranged such that only the print head carrier 16 is driven directly, whereas the cable guide carrier 32 is driven only indirectly via the link 42.

The invention claimed is:

1. A print head mounting structure comprising:

a beam that extends along a scan axis y of the print head; and a carriage adapted to be driven for reciprocating movement along the beam, the carriage comprising:

a print head carrier for carrying the print head, the print head carrier having a first runner block arranged to guide the print head carrier along the beam, a cable guide carrier connected to a flexible cable guide that extends along the beam, the cable guide carrier having a second runner block arranged to guide the cable guide carrier along the beam independently of the print head carrier, and a link connecting the print head carrier and the cable guide carrier for joint movement along the beam, characterized in that the link is rigid and play-free in the direction of the scan axis y and is resilient in all remaining degrees of freedom.

2. The mounting structure according to claim 1, comprising a drive mechanism arranged to drive the carriage along the beam, the drive mechanism being arranged to act directly only upon the print head carrier, whereas the cable guide carrier is driven only indirectly via the link.

3. The mounting structure according to claim 1, wherein the link is configured to deform like a leaf spring in a direction along an axis x normal to the scan axis y.

4. The mounting structure according to claim 3, wherein the link is configured as a hinge plate with cut-outs defining two spaced-apart hinge portions permitting the link to flex in a direction of an axis z normal to the axes x and y.

5. The mounting structure according to claim 1, wherein the link is directly attached to the runner blocks and is disposed in the vicinity of a guide rail along which the runner blocks are guided along the beam.

6. The mounting structure according to claim 1, wherein the print head carrier has two first runner blocks spaced apart in the direction of the scan axis y.

7. The mounting structure according to claim 6, wherein the second runner block is disposed between the two first runner blocks.

8. The mounting structure according to claim 1, wherein the print head carrier has a top part supported and guided on a top surface of the beam, and a downwardly cranked part engaging another guide surface on a side face of the beam.

9. The mounting structure according to claim 8, wherein an opening for mounting at least one print head is formed in the downwardly cranked part of the print head carrier.

10. The mounting structure according to claim 3, further comprising a drive mechanism arranged to drive the carriage along the beam, the drive mechanism being arranged to act directly only upon the print head carrier, whereas the cable guide carrier is driven only indirectly via the link.

11. The mounting structure according to claim 3, wherein the link is directly attached to the runner blocks and is disposed in the vicinity of a guide rail along which the runner blocks are guided along the beam.

12. The mounting structure according to claim 3, wherein the print head carrier has two first runner blocks spaced apart in the direction of the scan axis y.

13. The mounting structure according to claim 3, wherein the print head carrier has a top part supported and guided on a top surface of the beam, and a downwardly cranked part engaging another guide surface on a side face of the beam.

* * * * *